US005880696A

United States Patent [19]

Koleda

[11] Patent Number: 5,880,696

[45] Date of Patent: Mar. 9, 1999

[54] RETRACTABLE ANTENNA FOR A RADIO TRANSMITTING AND RECEIVING DEVICE

[75] Inventor: Eugeniusz Zachariusz Koleda, Herlev, Denmark

[73] Assignee: Nokia Mobile Phones Ltd., Salo, Finland

[21] Appl. No.: 745,042

[22] Filed: Nov. 7, 1996

[30] Foreign Application Priority Data

Nov. 8, 1995 [EP] European Pat. Off. ..... 95117608

[51] Int. Cl.[6] ..... H01Q 1/24

[52] U.S. Cl. ..... 343/702; 343/900

[58] Field of Search ..... 343/702, 715, 343/787, 900, 901, 903; H01Q 1/24

[56] References Cited

U.S. PATENT DOCUMENTS

| | | | |
|---|---|---|---|
| 3,611,390 | 10/1971 | Chiron et al. | 343/787 |
| 4,998,078 | 3/1991 | Hulkko | 333/109 |
| 5,168,278 | 12/1992 | Morita | 343/702 |
| 5,276,920 | 1/1994 | Kuisma | 455/101 |
| 5,341,149 | 8/1994 | Valimaa et al. | 343/895 |
| 5,343,213 | 8/1994 | Kottke et al. | 343/702 |
| 5,467,097 | 11/1995 | Toko | 343/702 |
| 5,521,605 | 5/1996 | Koike | 343/702 |
| 5,561,439 | 10/1996 | Moilanen | 343/846 |
| 5,710,567 | 1/1998 | Funke | 343/702 |

FOREIGN PATENT DOCUMENTS

| | | |
|---|---|---|
| 2 287 130 | 9/1995 | United Kingdom . |
| WO 94/06319 | 3/1994 | WIPO . |
| WO 95/08199 | 3/1995 | WIPO . |

OTHER PUBLICATIONS

Patent Abstracts of Japan, vol. 14 No. 18 (E–873) 16 Jan. 1990 & JP–A–01 261004 (Matsushita) 18 Oct. 1989.

*Primary Examiner*—Hoanganh Le
*Assistant Examiner*—Tan Ho
*Attorney, Agent, or Firm*—Perman & Green, LLP

[57] ABSTRACT

The invention relates to a radio transmitting and receiving device with a housing (8) and an antenna (1) which has a rod (2) which can be retracted and extended through an opening (10) in the housing. The rod (2) can be secured in its respective end positions by a magnetic force.

29 Claims, 9 Drawing Sheets

RETRACTABLE ANTENNA FOR A RADIO TRANSMITTING AND RECEIVING DEVICE

BACKGROUND OF THE INVENTION

1. Field of the Invention

The invention relates to a radio transmitting and receiving device according to the preamble of Patent claim 1. In such a device, a housing of the device can be equipped with an antenna which has a rod which can be retracted and extended through an opening in the housing.

2. Description of the Prior Art

The use of the device, and the associated frequent pulling-out and pushing-in of the rod out of and into the housing of the device leads however in the long term to wear of the guides for the rod and thus to unreliability with respect to its positional accuracy. Under certain circumstances, this can result in the rod not moving into its end position and thus satisfactory electrical contact is not made between contact elements present there on the rod and a tap which is itself connected to the circuit of the device. In such a case, the antenna must be replaced, which is however only possible with difficulty, especially since a special tool must be used for this purpose. The same also applies to other damage to the antenna, for example bending or fracture.

SUMMARY OF THE INVENTION

The invention is based on the object of providing a radio transmitting and receiving device of the type mentioned at the beginning in which the antenna is made easier to handle.

The means of achieving the objective set is disclosed in the characterizing part of Patent claim 1. Advantageous refinements of the invention can be found in the subclaims.

A radio transmitting and receiving device according to the invention is characterized in that the rod can be secured in its respective end position by a magnetic force.

According to the invention, the rod, after first having been displaced manually, is pulled into its end position by the magnetic force, and secured there. This relates both to the state in which the rod is completely pulled out of the device and the state in which it has been completely pushed into the device. As a result of the effect of the magnetic force, wear phenomena in the region of the guides of the rod only play a subordinate role so that even after a very large number of displacements of the rod it can always be held precisely in its end position. This involves reliable positioning of contact elements, which always ensures statisfactory connection of the antenna to the circuit of the device.

A first embodiment of the present invention is characterized in that the rod has ferromagnetic sections in the regions of its two ends and a fixed magnetic arrangement, which attracts the rod in order to secure it in its respective end position via in each case one of the ferromagnetic sections, is present in the housing.

A second embodiment of the present invention is characterized in that the rod has a ferromagnetic section in the region of its lower end (closer to the housing) and two fixed magnetic arrangements are present in the housing in a distance along the length of the rod.

A third embodiment of the present invention is characterized in that the rod has magnet arrangements in the region of its two ends and a fixed ferromagnetic section is present in the housing to be attracted by one of the magnet arrangements, respectively.

Further, a fourth embodiment of the present invention is characterized in that the rod has a magnet arrangement in the region of its lower end (closer to the housing) and two fixed ferromagnetic sections are present in the housing in a distance along the length of the rod.

According to an advantageous refinement of the invention, the rod is electrically connected to a transmitting and receiving circuit of the device via a magnet arrangement/ferromagnetic section. In this case, the ferromagnetic sections/magnet arrangements assume the function of contact elements on the rod so that separate contact elements can be dispensed with, which simplifies the design of the antenna.

According to another very advantageous refinement of the invention, the rod is slidingly mounted in an elastic sleeve which is permanently inserted into the opening in the housing.

The sleeve preferably has a wall region which protrudes outwards in elastic fashion and is bounded by two axial slots which start from the rear end side of the sleeve. The sleeve can thus be simply inserted into the opening in the housing which, for this purpose, has an axial groove for receiving the outwardly protruding wall region of the sleeve, the axial grove being closed at the external side of the opening in the housing. The sleeve can thus be inserted into the opening in the housing in a locking fashion.

Preferably, the housing can have a channel which, when the sleeve is inserted, runs essentially perpendicularly towards that wall region of the sleeve which protrudes outwards in an elastic fashion, so that it is possible to press inwards the outwardly protruding wall region of the sleeve using a pin which is passed through the channel. Now, the sleeve can be pulled out of the opening in the housing counter to its insertion direction, and the rod can be pulled with it.

According to another refinement of the invention, the side walls of the axial groove can also be bevelled in the circumferential direction of the opening in the housing. In this case, the sleeve only needs to be rotated in order to press its outwardly projecting wall region inwards so that the sleeve can then also be removed from the opening in the housing. In order to be able to grasp the sleeve, it can have a collar which comes to rest on the outside of the housing.

According to another further refinement of the invention, the magnet arrangement can receive the rod in a sliding manner and be held securely in a sleeve which is screwed into the opening in the housing.

Preferably, as magnet arrangement a permanent magnet arrangement is used. The radio transmitting and receiving device itself can be of any desired design and in particular may also take the form of a portable device. In the latter case, it may be for example a portable or cordless telephone or radiotelephone.

BRIEF DESCRIPTION OF THE DRAWINGS

The invention is described in greater detail below with reference to the drawing, in which:

FIG. 1 relates to a first exemplary embodiment of a radio transmitting and receiving device according to the invention. Here, a partial detail is shown in the region of a rod antenna.

DETAILED DESCRIPTION OF THE INVENTION

Figure 1:
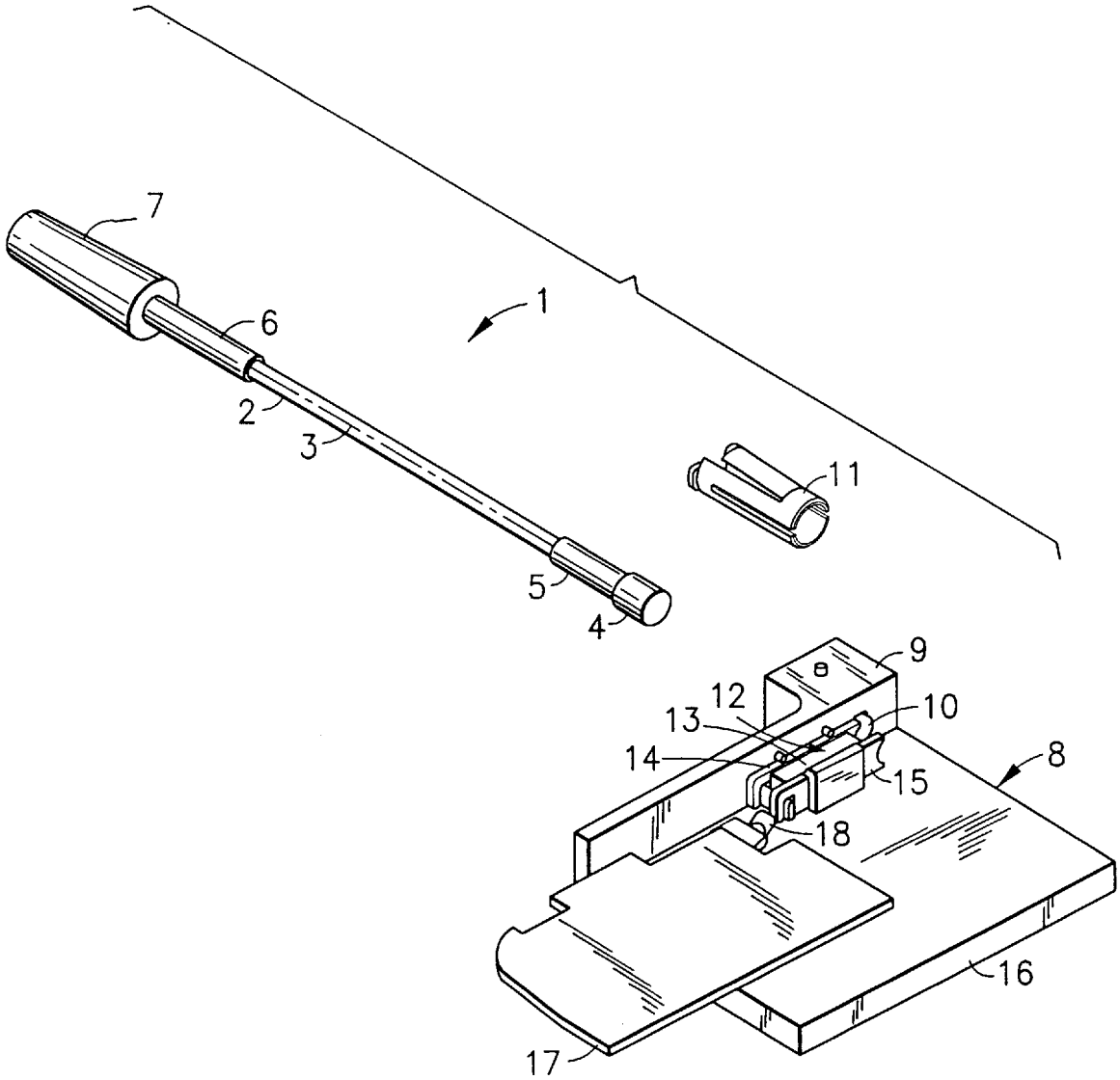
FIG. 1 shows a detail of a radio transmitting and receiving device according to the invention with a magnet arrangement lying laterally with respect to the rod.

The rod antenna bears the reference symbol 1 and has a rod 2 which consists of an elastic and electrically insulating material, for example plastic. Inside the rod 2 an antenna feeder 3 runs in the longitudinal direction, in a partial region of the rod 2. The antenna feeder 3 is shown in FIG. 1 by broken lines and is encased by the material of the rod 2.

The antenna feeder 3 is connected in an electrically conductive way at its housing-side end to a first ferromagnetic section 4. A guide section 5 adjoins the first ferromagnetic section 4 in the direction towards the free end of the rod antenna 1. This guide section 5 can consist of any desired material, that is to say also of ferromagnetic material, and can be integrally connected to the first ferromagnetic section 4. The diameter of the guide section 5 is greater than that of the rod 2, while the diameter of the first ferromagnetic section 4 is greater than that of the guide section 5.

At its free end, the rod 2 has a second ferromagnetic section 6. Here, in the present case, this second ferromagnetic section 6 is not connected to the antenna feeder 3 which ends just before the second ferromagnetic section 6. The second ferromagnetic section 6 has a diameter which corresponds to the diameter of the guide section 5. Here, the second ferromagnetic section 6 bears a further antenna component 7 which contains a helix antenna for example in its interior, which helix antenna is connected in an electrically conductive fashion to the second ferromagnetic section 6. The further antenna component 7 can be a cast plastic element.

The rod antenna 1 is mounted on a housing 8 of the radio transmitting and receiving device in such a was that it can be pushed into the housing 8 as far as the further antenna component 7. It can be pulled out of the housing 8 again by pulling manually on the further antenna component 7. However, in such a case the first ferromagnetic section 4 remains inside the housing 8 while the guide section 5 remains inside a wall 9 of the housing.

In order to retract and extend the rod into the housing 8 and out of it, there is a cylindrical through-opening 10 or opening in the housing inside the wall 9. An elastic sleeve 11 is inserted into this through-opening 10 in a clamping fashion, the said sleeve 11 itself receiving the rod 2. Here, the internal diameter of the sleeve 11 corresponds to the external diameter of the guide section 5 and of the second ferromagnetic section 6. The external diameter of the sleeve 11 corresponds to the internal diameter of the through-opening 10.

The design of the sleeve 11 and its attachment in the through-opening 10 are described in detail later.

A magnetic arrangement 12 is permanently attached to the inside of the housing wall 9. This magnet arrangement 12 comprises a permanent magnet 13 and two pole plates 14 and 15 on opposite sides of the permanent magnet 13. The pole plates 14 and 15 each come to rest in a plane which extends perpendicularly to the longitudinal direction of the through-opening 10. Here, the pole plates 14 and 15 are of concave construction on their end side facing the through-opening 10, such that their end faces extend concentrically to the longitudinal axis of the through-opening 10 there. The radius of curvature of the concave end sides corresponds to the radius of the first ferromagnetic section 4.

The housing 8 of the radio transmitting and receiving device has a rear wall 16 on whose inside for example a circuit board 17 is mounted, on which a transmitting and receiving circuit (not illustrated in greater detail) of the device according to the invention is entirely or partially located. In order to connect this transmitting and receiving circuit electrically, an elastic spring contact 18 is attached to the circuit board 17, which spring contact 18 presses against one of the pole plates, for example against the rear end face of the pole plate 15.

If the sleeve 11 is inserted into the through-opening 10 in a permanent or clamping fashion and if the sleeve 11 receives the rod 2, the latter can be pushed into the housing 8 with the exception of the further antenna component 7. Here, the second ferromagnetic section 6 comes to rest inside the sleeve 11, the length of the second ferromagnetic section 6 being selected such that this also comes to rest in the region of the two pole plates 14 and 15 when the further antenna component 7 strikes against the wall 9. The magnetic flux of the magnet 13 is thus directed via the pole plates 14 and 15 through the second ferromagnetic section 6 so that in this position the rod antenna 1 is secured by the magnet arrangement 12. Here, the second ferromagnetic section 6 fits into the interior of the sleeve 11 whose internal diameter is only slightly larger than the external diameter of the second ferromagnetic section 6. The antenna device which is present inside the further antenna component 7 is now electrically connected to the transmitting and receiving circuit on the circuit board 17 via the second ferromagnetic section 6, the magnet arrangement 12 or the pole plate 15 and the spring contact 18. In this state, the circuit can receive a signal coming from the outside.

If, in contrast, the rod antenna 1 is pulled out of the housing 8, the guide section 5 moves into the interior of the sleeve 11 while at the same time the first ferromagnetic section 4 comes to rest in the region of the two pole plates 14 and 15. Here, the guide section 5 is guided through the sleeve 11 whose internal diameter is only slightly larger than the external diameter of the guide section 5 while the first ferromagnetic section 4 prevents the rod antenna 1 being pulled out completely from the housing 8. The first ferromagnetic section 4 has an external diameter which, as already mentioned, is larger than the external diameter of the guide section 5 so that the first ferromagnetic section 4 strikes against the end-side edge of the sleeve 11 and thus serves as a stop. If the first ferromagnetic section 4 bears on the sleeve 11, the magnetic flux of the magnet arrangement 12 passes simultaneously via the pole plates 14 and 15 through the first ferromagnetic section 4 so that the latter is attracted by the magnet arrangement 12 and thus secured. In this state, the antenna feeder 3 is electrically connected to the transmitting and receiving circuit on the circuit board 17, if appropriate via the electrically conductive guide section 5, the first ferromagnetic section 4, the magnet arrangement 12 or the pole plate 15 and the spring contact 18. It is now possible to transmit and receive in order to make a call. If the guide section 5 were to consist of electrically insulating material, the antenna feeder 3 could pass through it and only be electrically connected to the first ferromagnetic section 4.

Figure 2:
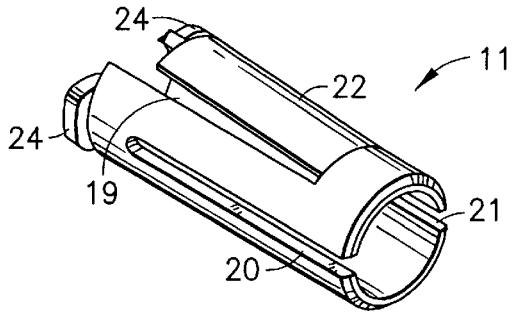
FIG. 2 shows an elastic sleeve for attaching the rod to the housing of the radio transmitting and receiving device according to FIG. 1.
Figure 3:
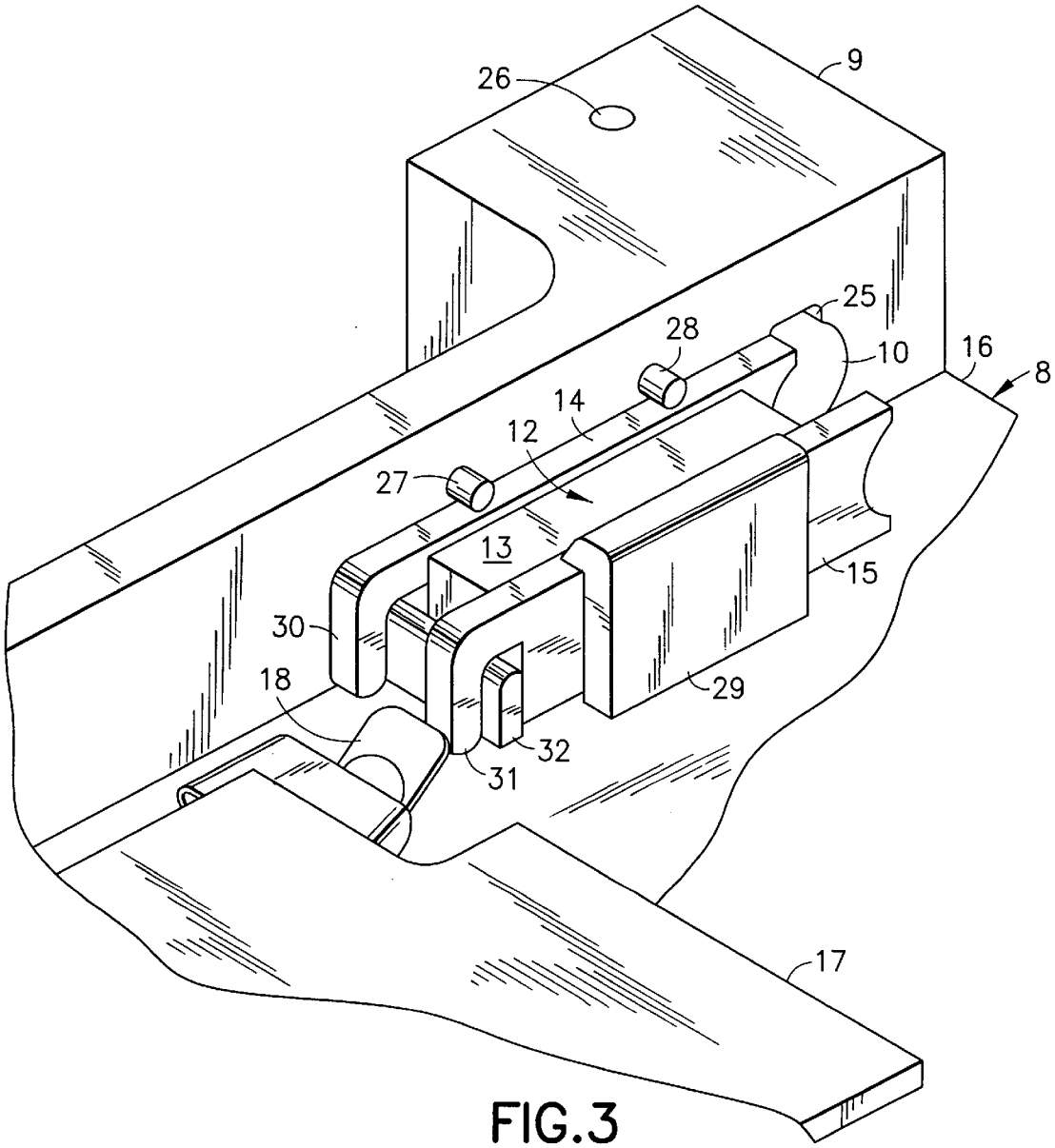
FIG. 3 shows an enlarged housing-side view of the device according to FIG. 1.

FIGS. 2 and 3 show, in an enlarged view, the sleeve 11 and the respective section of the housing 8, identical components to those in FIG. 1 being provided with the same reference symbols and not being described again.

According to FIG. 2, the sleeve 11 has a plurality of axial slots which start from different end sides of the sleeve 11. Three axial slots 19, 20 and 21 can be seen in FIG. 2, the axial slot 19 starting from the outer end side of the sleeve 11 while the axial slots 20 and 21 start from the inner end side of the sleeve 11. A wall region 22, which projects outwards in an elastic fashion, of the sleeve 11 is maintained by providing a further axial slot 23, which can only be seen in FIGS. 4 and 5. This further axial slot 23 also starts from the outer end side of the sleeve 11 and is adjacent to the axial slot 19. Both slots 19 and 23 extend not quite as far as the inner end side of the sleeve 11 so that the sleeve wall lying between them can be bent outwards in order to form the elastic wall region 22. This wall region 22 extends not quite as far as the outer end side of the sleeve 11. In addition, the collar 24 is provided on this outer end side of the sleeve 11 (on the left in FIG. 2), the said collar 24 preventing the sleeve 11 dropping through the through-opening 10 when it is inserted into it. Instead, the collar 24 strikes against the outside of the wall 9, thus positioning the sleeve 11 in the axial direction within the through-opening 10.

The sleeve 11 has a certain degree of elasticity in the radial direction owing to the axial slots 19, 20, 21 and 23 which start from various end sides of the sleeve 11 and also to a further axial slot. It can thus be pressed over the first ferromagnetic section 4 of the rod antenna, the external diameter of which ferromagnetic section 4 is larger than the internal diameter of the sleeve 11 when it is in the radially extended state. In the non-radially extended state the internal diameter of the sleeve 11 corresponds to the external diameter of the guide section 5 or to the external diameter of the second ferromagnetic section 6.

When the sleeve 11 receives the rod 2, it can be pressed from outside into the through-opening 10 until the collar 24 strikes against the outside of the wall 9. While a prescribed rotational position of the sleeve 11 is complied with, the initially inwardly pressed elastic wall region 22 then jumps into an axial groove 25 which is located inside the housing wall 9 on the side of the through-opening 10. This axial groove 25 extends from the inside of the wall 9 in the direction of its outside but without reaching the latter. The length of the axial groove 25 is dimensioned here such that when the sleeve 11 is completely inserted into the through-opening 10 the end side, pointing in the direction of the outer end side of the sleeve 11, of the elastic wall region 22 strikes against the end of the axial groove 25. In this way, axial securing of the sleeve 11 within the wall 9 is achieved.

If the sleeve 11 is to be removed again from the through-opening 10 in the direction of its outer end side, for this purpose the elastic wall region 22 must be pressed in the direction of the centre of the sleeve 11. For this purpose, there is a channel 26 inside the wall 9, which channel 26 lies radially with respect to the through-opening 10 and is located in the region of the axial groove 27. In other words, this channel 26 ends above the free end of the elastic wall region 22 so that the latter can be pressed downwards or into the interior of the sleeve 11, for example by means of a thin rod which is passed through the channel 26. The sleeve 11 can then be pulled out of the through-opening 10 in the direction of its outer end side, and the rod antenna 1 can be pulled with it.

FIG. 3 shows the attachment of the mag n et arrangement 12 in the interior of the housing 8. Two inwardly pointing projections 27, 28 are provided on the inside of the wall 9 and a clamp 29 is provided on the rear wall 16 of the housing 8 in order to receive the magnet arrangement 12 between them. Moreover, arms 30, 31 on the rear of the pole plates 14, 15 engage around a web 32 which is also attached to the rear wall 16 of the housing 8 in order to prevent the magnet arrangement being displaced in the direction of the through-opening 10.

Figure 4:
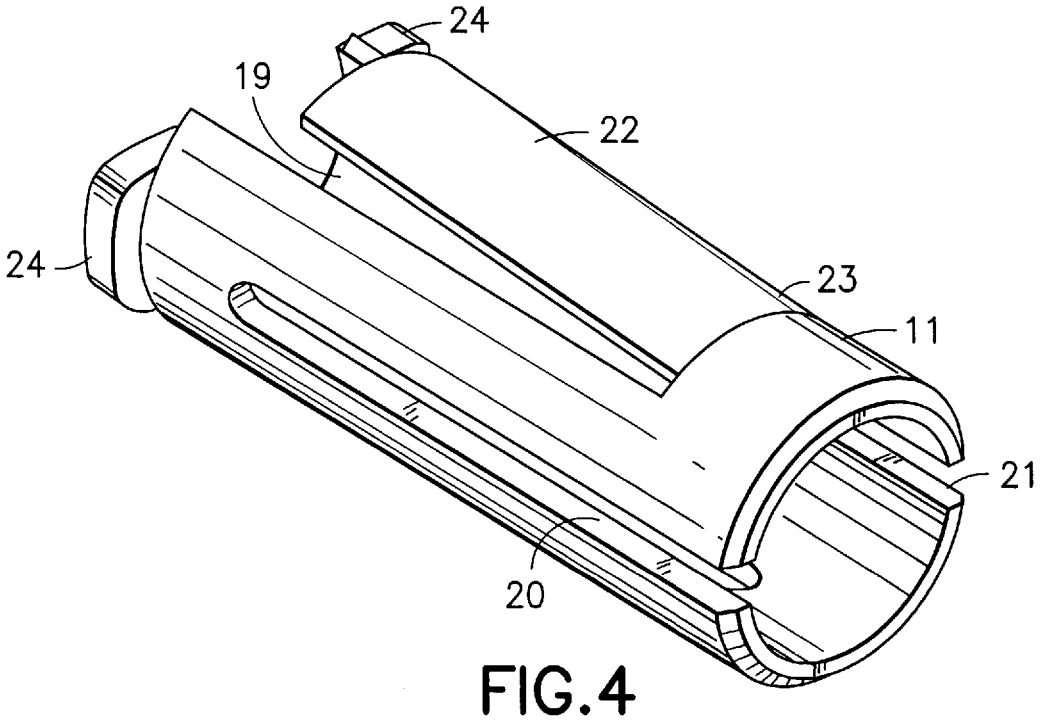
FIG. 4 shows the sleeve according to FIG. 2 in an enlarged view.
Figure 5:
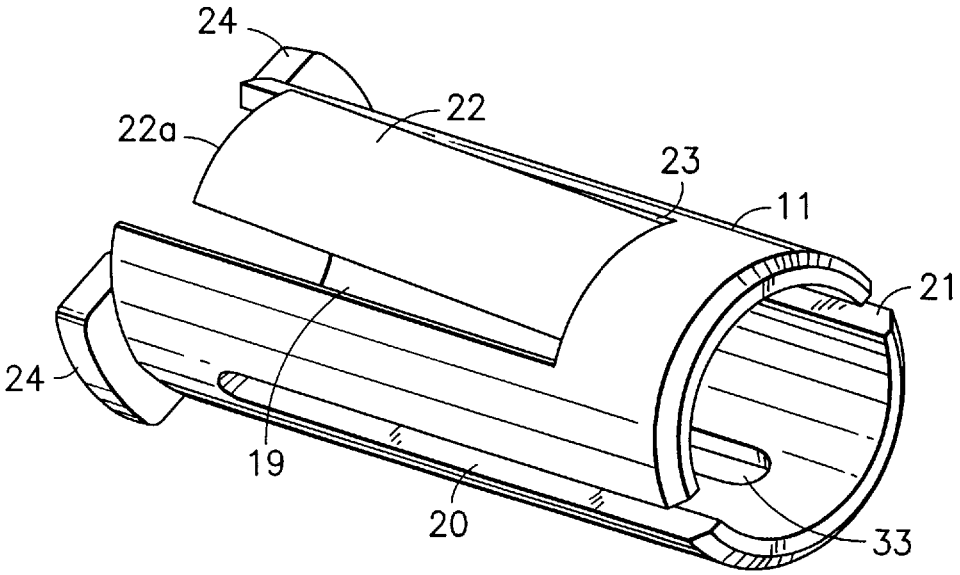
FIG. 5 shows the sleeve according to FIG. 2 in an enlarged view in a position rotated with respect to FIG. 4.

FIGS. 4 and 5 show once more the sleeve 11 in various rotational positions in enlarged view. Identical elements to those in FIG. 2 are provided here with the same reference symbols and are not described again. As is shown in particular by FIG. 5, a further axial slot 33, which comes to rest between the axial slots 20 and 21 but starts from the outer end side of the sleeve 11, on the left in FIG. 5, is also provided.

The sleeve 11 itself can consist of metal or plastic. In contrast, the housing 8, and in particular the wall 9 consist of electrically insulating material, for example of plastic also.

A second exemplary embodiment of the invention is shown by FIGS. 6 to 17. Here also, identical elements to those in FIGS. 1 to 5 are again provided with the same reference symbols.

Figure 6:
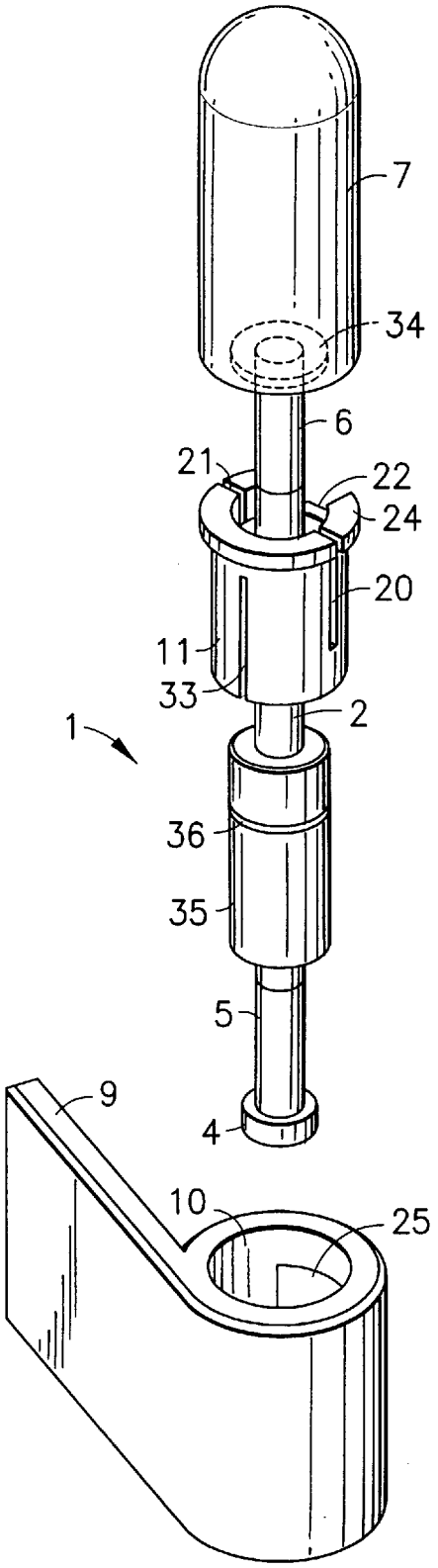
FIG. 6 shows a radio transmitting and receiving device with a magnet arrangement lying coaxially with respect to the rod.
Figure 7:
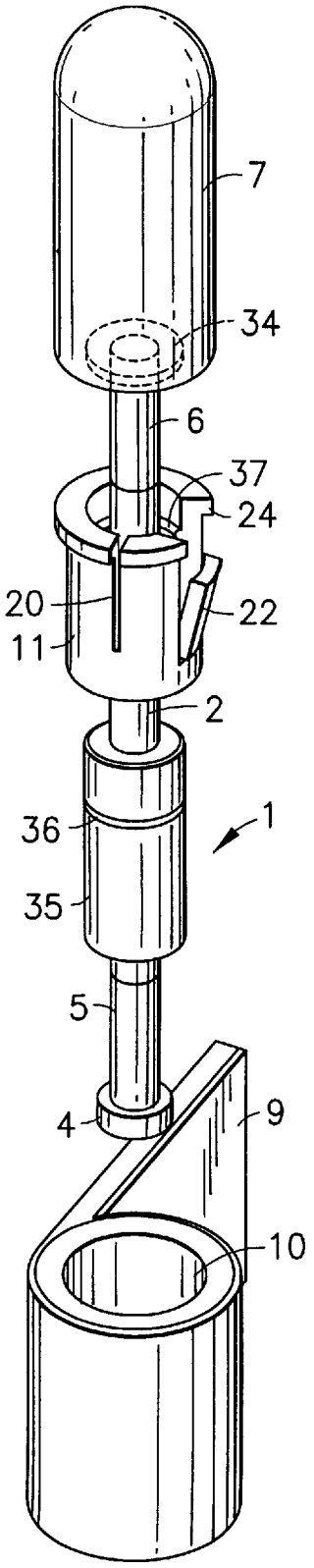
FIG. 7 shows the design according to FIG. 6 in another view.

In FIGS. 6 and 7, the antenna arrangement is shown with an attachment device in various rotational positions in order to make their design clearer.

Here also, the rod antenna 1 has a rod 2 in whose interior the antenna feeder 3 runs. However, the rod 2 now has an external diameter which corresponds to the external diameter of the guide section 5 or of the second ferromagnetic section 6. The first ferromagnetic section 4 is of relatively short construction in the axial direction and again has an external diameter which is larger than the external diameter of the guide section 5. The second ferromagnetic section bears the further antenna component 7, it is being possible for a ferromagnetic disc 34, similar to the first ferromagnetic section 4, to be present on the underside of the further antenna component 7, the said disc 34 being connected to the second ferromagnetic section 6 in an electrically conductive fashion. The elements 6 and 34 can also be integrally connected to one another.

A hollow-cylindrical permanent magnet arrangement 35, which concentrically surrounds the rod 2 and receives it in a fitting or sliding fashion is located on the rod 2. The rod 2 can be displaced here in relation to the magnet arrangement 35 in the axial direction until either the disc 34 strikes against one of the end sides of the magnet arrangement 35 or the first ferromagnetic section 4 strikes against the other end side of the magnet arrangement 35.

The magnet arrangement 35 is securely held by the elastic sleeve 11. For this purpose, the magnet arrangement 35 has a circumferential groove 36. A circumferential flange 37, which is located on the internal circumferential face of the sleeve 11, engages in this circumferential groove 36. The magnet arrangement can be secured in the interior of the sleeve 11 by means of this groove and tongue connection. The sleeve 11 is in turn of elastic construction in the radial direction, specifically as a result of the previously mentioned axial slots. They in turn extend starting from different end sides of the sleeve 11. Otherwise, the elastic wall region 22, already described in conjunction with the first exemplary embodiment, is also present here. In contrast with FIG. 5, the axial slots 20 and 21 in FIGS. 6 and 7 start from the outer end side while the axial slot 33 starts from the inner end side of the sleeve. As a result of the elasticity of the sleeve 11, the circumferential flange 37 can thus be initially pushed over the magnet arrangement 35 until it engages elastically in the circumferential groove 36. The axial positions of the circumferential groove 36 and circumferential flange 37 are selected such that the end face of the magnet arrangement 35 which is the upper one in FIGS. 6 and 7 is aligned with the upper edge of the collar 24 of the sleeve 11 so that the disc 34 can strike against the upper end face of the magnetic arrangement 35. At the same time, the lower end face of the magnet arrangement 35 protrudes out downwards over the lower end side of the sleeve 11. When the rod antenna is installed, it is therefore possible to connect this end of the magnet arrangement 35 to a sprung contact in order to make an electrical connection between the magnet arrangement 35 and the transmitting and receiving circuit of the device, as was also the case in first exemplary embodiment. The sprung contact is not illustrated in detail here.

The attachment of the magnet arrangement 35 on the rod 2 can be made, in a single-component magnet arrangement 35, by initially feeding the rod 2 through the said magnet arrangement 35 before the first ferromagnetic section 4 is attached to the guide section 5. The magnet arrangement can however also be initially in two parts and consist of two half shells which are bonded after they are positioned on the rod 2.

After the magnet arrangement 35 has been secured to the rod 2, which passes through it, within the sleeve 11, the sleeve 11 is inserted into the through-opening 10 until the collar 24 strikes against the upper housing edge of the wall 9, within which the through-opening 10 is located. The wall 9 is illustrated here as a partial element which is attached to the housing 8. The already mentioned axial groove 25 is located on the circumferential side of the through-opening 10 in order to receive the elastic wall region 22. It ends at a distance below the upper end side of the wall region surrounding the through-opening 10. The free end face of the elastic wall region 22 then strikes against the corresponding end of the axial groove 25 when the sleeve 11 is completely inserted into the through-opening 10 so that, in this way, axial securing of the sleeve 11 can be achieved.

When the rod antenna 1 is completely pushed into the housing 8, the disc 34 is attracted by the magnet arrangement 35, as a result of which the rod 2 is secured. Now, the disc 34, and the helix, connected electrically to it, within the further antenna component 7 are connected to the transmitting and receiving circuit via the magnet arrangement 35 and the elastic contact acting on them. The circuit is now capable of reacting to a call.

If, in contrast, the rod antenna is completely pulled out of the housing, the first ferromagnetic section 4 strikes against the lower end face of the magnet arrangement 35, the first ferromagnetic section 4 being attracted by the magnet arrangement 35 and as a result secured. The rod antenna is thus held in its extended position. Now, the antenna feeder 3, located in the interior of the rod 2, is electrically connected to the transmitting and receiving circuit via the first ferromagnetic section 4 and the magnetic arrangement 35 as well as via the elastic contact acting on them, so that a telephone call can now be made.

Figure 8:
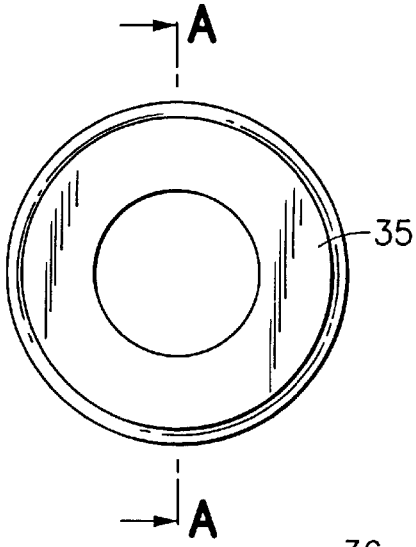
FIG. 8 shows a top view of the magnet arrangement according to FIG. 6.
Figure 9:
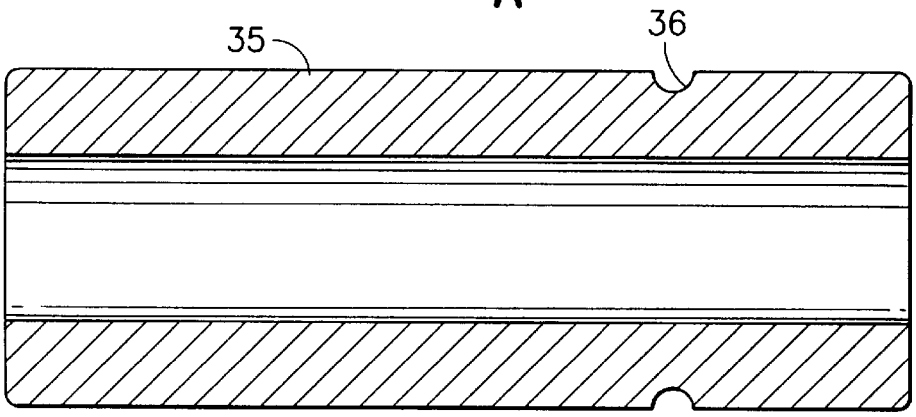
FIG. 9 shows a longitudinal section through the magnet arrangement according to FIG. 8.
Figure 10:
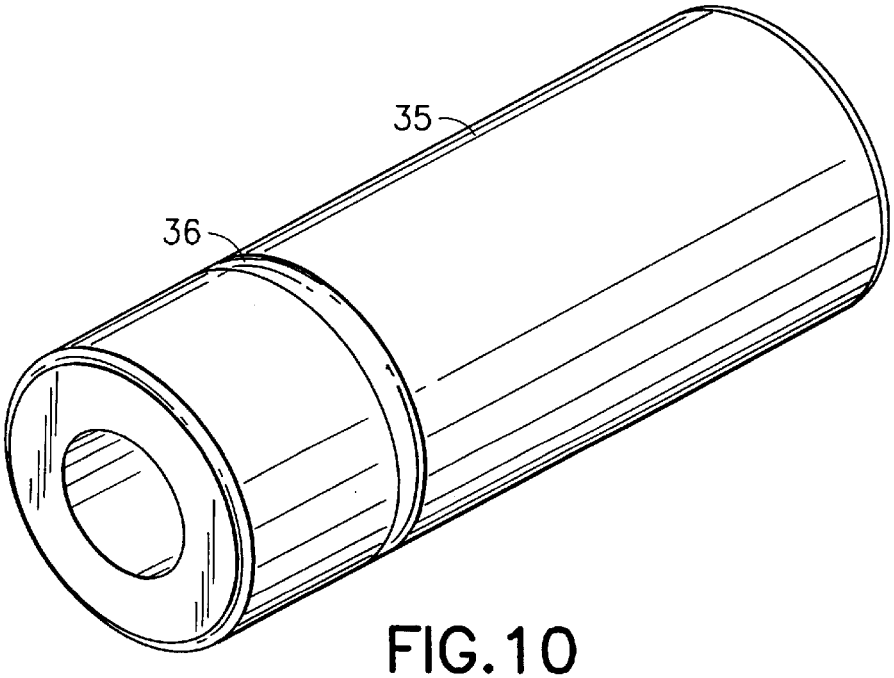
FIG. 10 shows a perspective view of the magnet arrangement according to FIGS. 8 and 9.

FIGS. 8, 9 and 10 each show a top view, an axial section and a perspective view of the magnet arrangement 35. The magnet arrangement 35 is of hollow-cylindrical design and has an internal diameter which corresponds to the external diameter of the rod 2 or of the sections 5 and 6. The sections 5 and 6 and the rod 2 can thus slide within the magnet arrangement 35. The circumferential groove 36 can have for example a semicircular profile.

Figure 11:
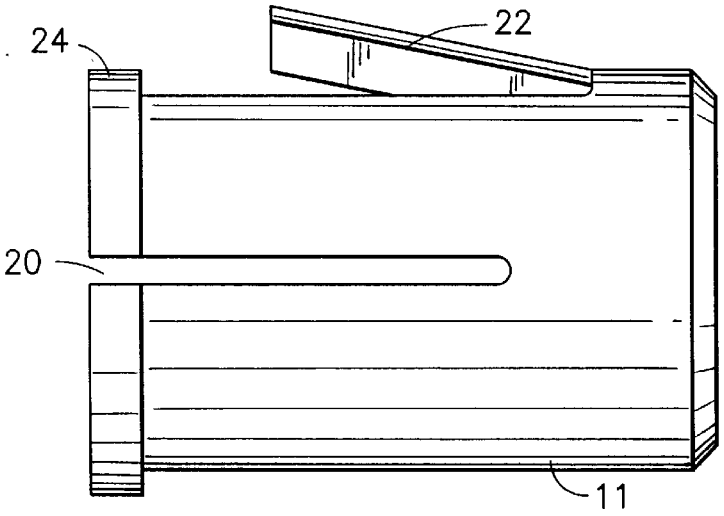
FIG. 11 shows a side view of a sleeve used in the embodiment according to FIG. 6.
Figure 12:
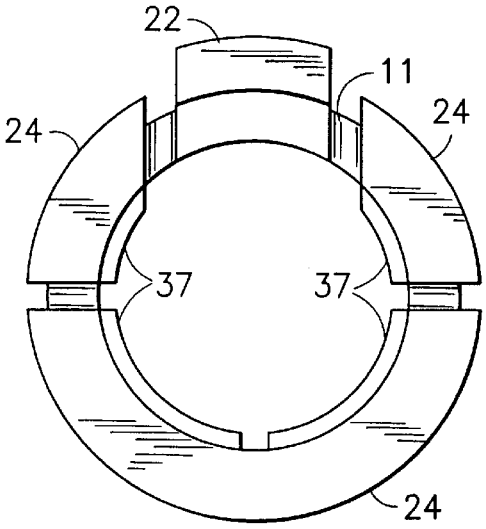
FIG. 12 shows a top view of the sleeve.
Figure 13:
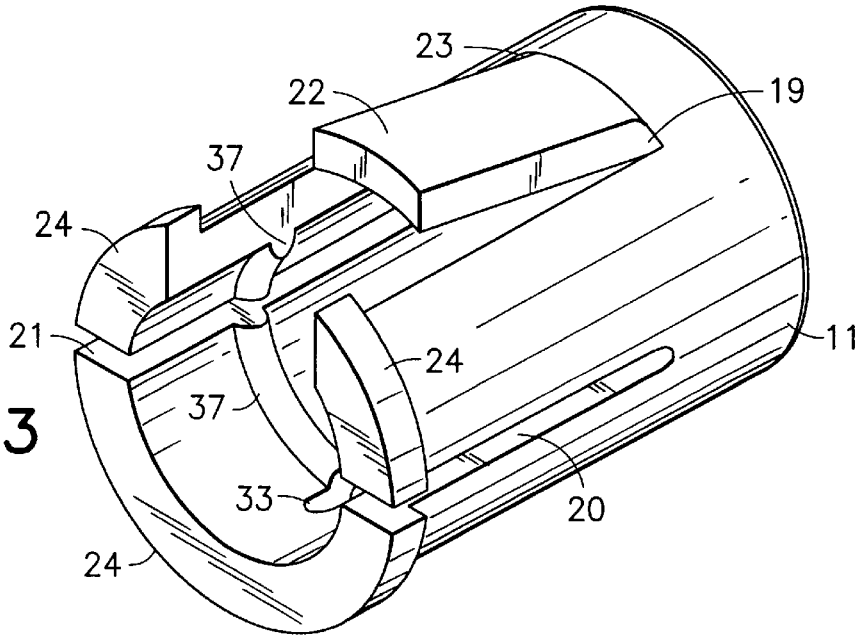
FIG. 13 shows a perspective view of the sleeve.

In contrast, FIGS. 11, 12 and 13 show a side view, an end view and a perspective view of the elastic sleeve 11. In the present case, the circumferential flange 37 on the internal circumferential face of the sleeve 11 also has a semicircular profile which fits the profile of the circumferential groove 36.

Figure 14:
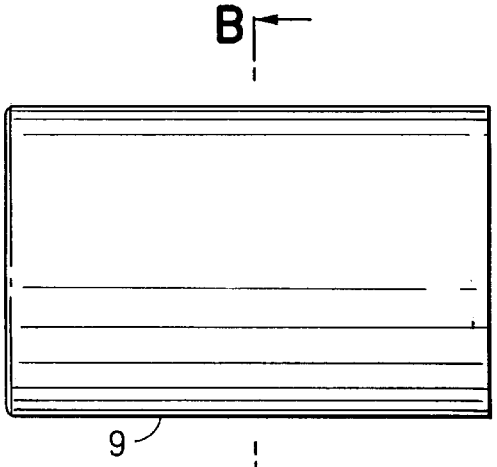
FIG. 14 shows a part of the housing of the device for receiving the sleeve.
Figure 15:
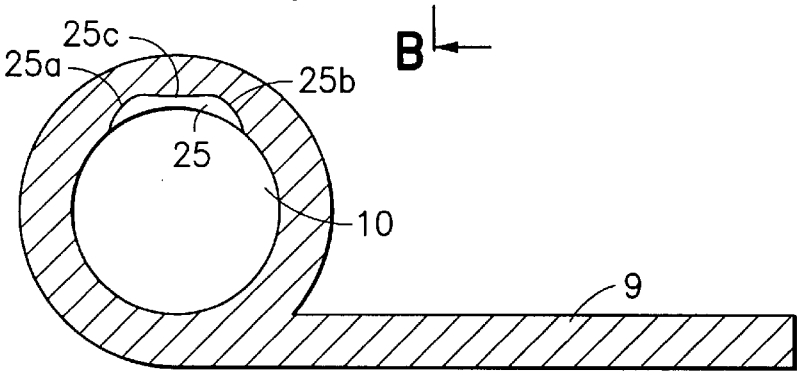
FIG. 15 shows a section through the structure according to FIG. 14 along the line B—B.
Figure 16:
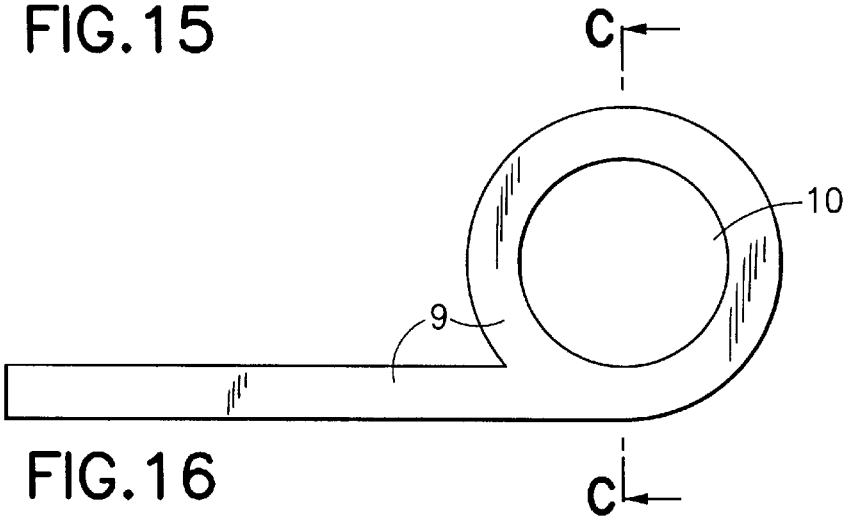
FIG. 16 shows a side view of the structure according to FIG. 14.
Figure 17:
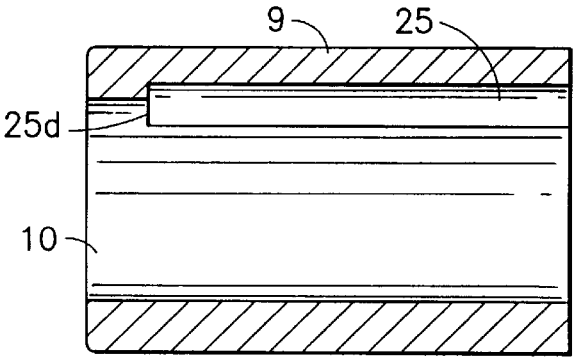
FIG. 17 shows a section through the structure according to FIG. 16 along the line C—C.

The component 9 or the wall of the device 8 is shown in FIGS. 14 to 17. Here, FIG. 14 is a side view, FIG. 15 is a sectional view along the line B—B in FIG. 14, FIG. 16 is a side view and FIG. 17 is a sectional view along the line C—C in FIG. 16. In FIGS. 15 and 17 in particular the axial groove 25 can be seen on the internal wall region of the through-opening 10.

According to FIGS. 15 and 17, the axial groove 25 has oblique side walls 25*a* and 25*b* which extend in the longitudinal direction of the through-opening 10. The side walls 25*a* and 25*b* are at an angle to the base surface 25*c* of the axial groove 25 which is greater than 90 degrees. Preferably, the junction area between the base surface 25*c* and the side walls 25*a* and 25*b* is also rounded.

If the elastic wall region 22 of the sleeve 11 is located within the axial groove 25 after the sleeve 11 is inserted into the through-opening 10, by turning the sleeve 11 within the through-opening 10 it is possible to cause the elastic wall region 22 to be moved out of the axial groove 25 by running up onto one of the side walls 25*a* or 25*b* (depending on the direction of rotation) and to be pressed in the direction of the central axis of the sleeve 11. If the sleeve 11 is further rotated sufficiently, the free end of the elastic wall region 22 thus disengages (designated in FIG. 5 by 22*a*) from the step 25*d*, formed by the axial groove 25 on the circumferential edge region of the through-opening 10 so that the sleeve 11, together with the rod antenna, can now be removed from the wall region 9 or from the device 8. The collar 24 can be appropriately constructed to make rotating the sleeve 11 within the through-opening 10 easier so that for example pliers or an open-jawed spanner can be applied there. The entire rod antenna 1 can thus be easily replaced if it has been damaged for whatever reasons. A special tool is not required for this. The collar 24 can, under certain circumstances, also be provided with a knurl so that the sleeve 11 can be rotated manually.

Figures 18, 19:
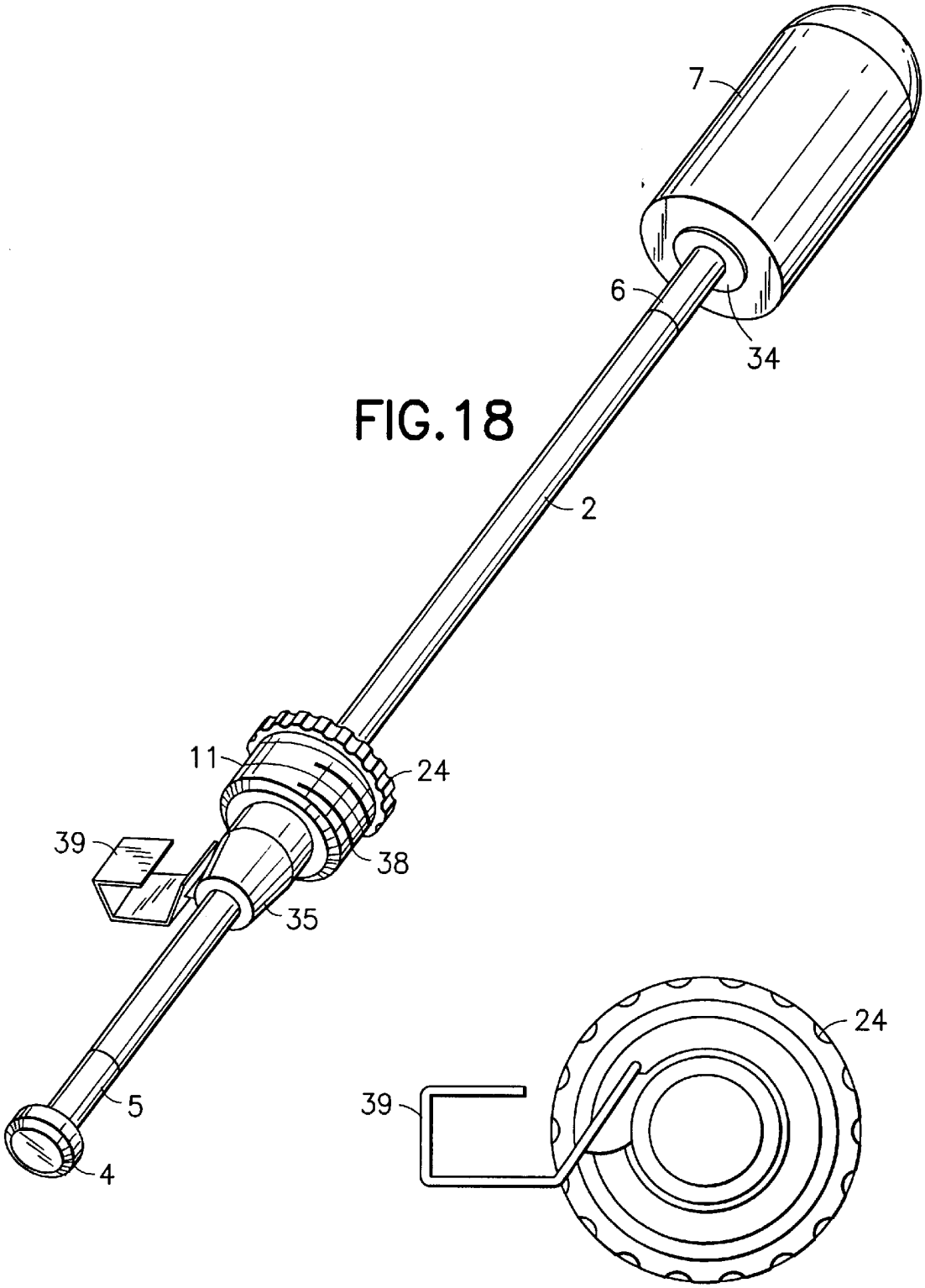
FIG. 18 shows a perspective view of a rod antenna with a magnetic arrangement lying coaxially with respect to it, which magnetic arrangement is held in a screw-locked sleeve.
FIG. 19 shows an end view of the arrangement according to FIG. 18.

FIGS. 18 and 19 show a third exemplary embodiment of the present invention. Components identical to those in FIGS. 6 to 17 are provided here with the same reference symbols and are not described again. In a modification of the second exemplary embodiment, the sleeve 11 is not of elastic construction here but rather the magnet arrangement 35 and sleeve 11 are permanently connected to one another, for example bonded. The sleeve 11 has on its outer circumferential face a thread 38 so that it can be screwed into a corresponding internal thread which is located in the through-opening 10. The collar 24 of the sleeve 11 has a knurl here in order to facilitate the screwing-in and screwing-out process of the sleeve 11.

As is clear in particular from FIGS. 18 and 19, an elastic spring contact 39 is attached to the circuit board and the housing in order to make an electrical connection between the magnet arrangement 35 and the transmitting and receiving circuit. Here, the spring contact 39 acts on that end of the electrically conductive magnet arrangement 35 which projects beyond the sleeve 11 on the housing side. Correspondingly, the electrical tap in the exemplary embodiment is also configured according to FIGS. 6 and 7. In those figures the magnet arrangement 35, which is electrically conductive, of course also projects beyond the sleeve 11 viewed in the direction of the interior of the housing 8.

Figure 20:
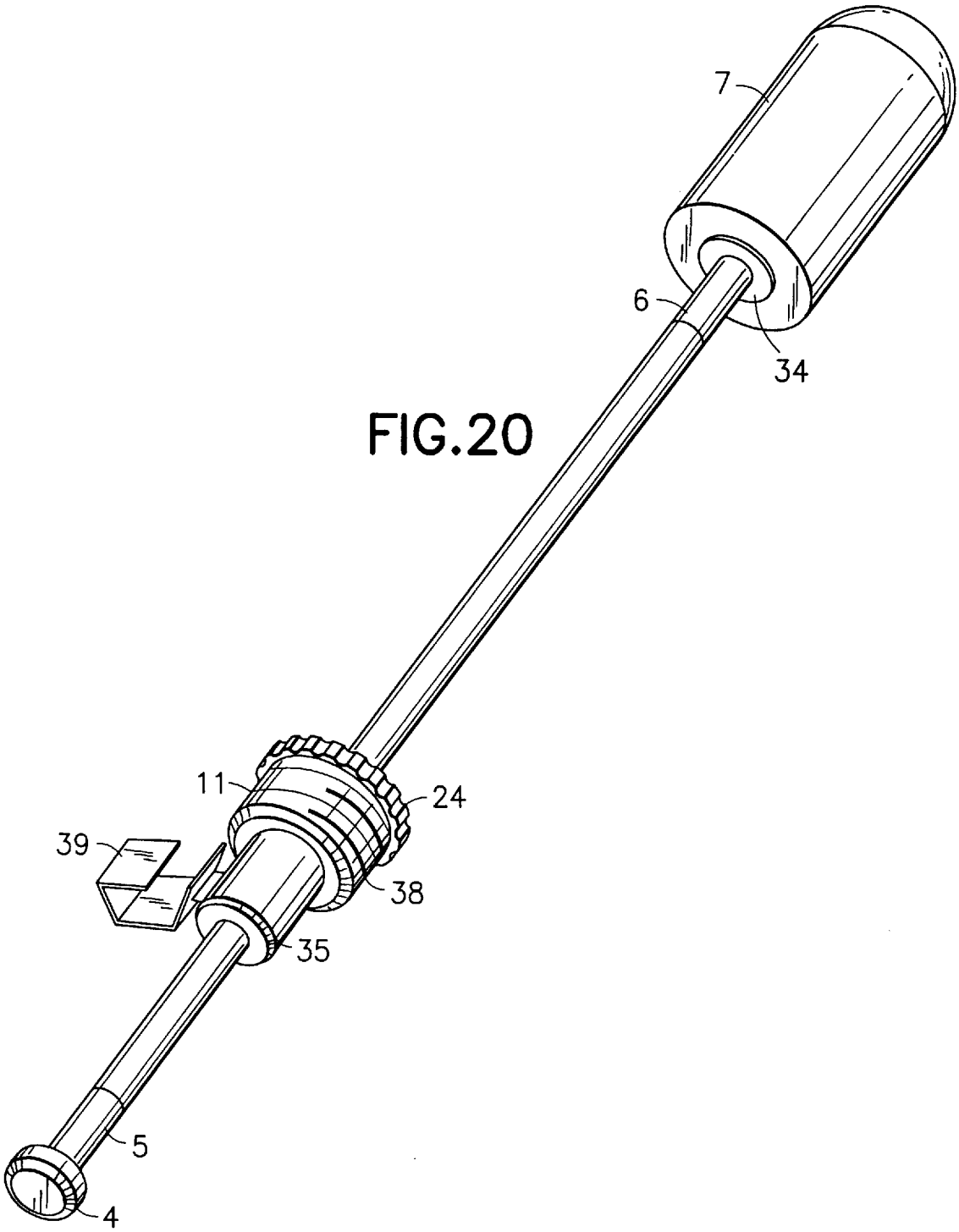
FIG. 20 shows a modification of the structure according to FIG. 18.

A fourth exemplary embodiment of the invention is shown in FIG. 20. This is a modification of the third exemplary embodiment with the effect that the region, acted on by the spring contact 39, of the magnet arrangement 35 is now of cylindrical construction and not conical as was the case in the exemplary embodiment according to FIGS. 18 and 19.

I claim:

1. Radio transmitting and receiving device with a housing, transmitting and receiving circuitry, a first antenna and a second antenna, said first and second antennas having a common rod which is movable between retracted and extended positions through an opening in the housing, characterized in that the first and second antennas are always decoupled from each other and that the rod is secured in its respective end position by a magnetic force with the first antenna being in electrical continuity with the transmitting and receiving circuitry at the extended position and with the second antenna being in electrical continuity with the transmitting and receiving circuitry at the retracted position.

2. Radio transmitting and receiving device according to claim 1, characterized in that the rod has ferromagnetic sections in the region of its two ends and a fixed magnet arrangement, which attracts the rod in order to secure it in its respective end position via in each case one of the ferromagnetic sections, is present in the housing.

3. Radio transmitting and receiving device according to claim 2 characterized in that one of the end stops is adjacent the housing and one of the end stops is distant from the housing, at least the end stop adjacent the housing being constructed as a ferromagnetic section or as part of one.

4. Radio transmitting and receiving device according to claim 3, characterized in that the end stop located at the free end of the rod is also formed from ferromagnetic material.

5. Radio transmitting and receiving device according to claim 2, characterized in that a magnet arrangement is attached to the inside of the housing in the region of the opening in the housing.

6. Radio transmitting and receiving device according to claim 5, characterized in that the magnet arrangement comprises a magnet with two pole plates which are each arranged in a plane lying perpendicular to the centre line of the opening in the housing.

7. Radio transmitting and receiving device according to claim 6, characterized in that the pole plates are recessed concavely on their side facing the opening in the housing.

8. Radio transmitting and receiving device according to claim 2 characterized in that the rod has at its housing-side end a ferromagnetic end stop which, when the rod is completely extended, strikes against the sleeve and comes to rest opposite the magnet arrangement, and in that it also has at its free end a ferromagnetic section which is of such a length that when the rod is completely retracted the said ferromagnetic section projects through the sleeve and partly also lies opposite the magnet arrangement.

9. Radio transmitting and receiving device according to claim 8, characterized in that the rod has a section in its centre region with a smaller diameter than the ferromagnetic sections and a guide section.

10. Radio transmitting and receiving device according to claim 2, characterized in that a magnet arrangement receives the rod in a sliding fashion and is held in a sleeve which is elastically pressed into the opening in the housing.

11. Radio transmitting and receiving device according to claim 10, characterized in that the magnet arrangement is held in the sleeve by means of a groove/tongue connection which runs in the circumferential direction between the magnet arrangement and sleeve.

12. Radio transmitting and receiving device according to claim 2, characterized in that the magnet arrangement receives the rod in a sliding fashion and is held in a sleeve which is screwed into the opening in the housing.

13. Radio transmitting and receiving device according to claim 1, characterized in that the rod has a ferromagnetic section in the region of its lower end and two fixed magnet arrangements are present in the housing in a distance along the length of the rod.

14. Radio transmitting and receiving device according to claim 1, characterized in that the rod has magnet arrangements in the region of its two ends and a fixed ferromagnetic section is present in the housing to be attracted by one of the magnet arrangements respective.

15. Radio transmitting and receiving device according to claim 1, characterized in that the rod has a magnet arrangement in the region of its lower end and two fixed ferromagnetic sections are present in the housing in a distance along the length of the rod.

16. Radio transmitting and receiving device according to claim 1, characterized in that the rod is electrically connected to a transmitting and receiving circuit via a magnet arrangement.

17. Radio transmitting and receiving device according to claim 16, characterized by a spring contact which acts on the magnet arrangement in order to make an electrical connection to the transmitting and receiving circuit.

18. Radio transmitting and receiving device according to claim 1, characterized in that the rod has end stops at its two ends.

19. Radio transmitting and receiving device according to claim 1, characterized in that an elastic sleeve is fastened into the opening in the housing and receives the rod in a sliding fashion.

20. Radio transmitting and receiving device according to claim 19, characterized in that the sleeve has a plurality of axial slots which start from different end sides of the sleeve.

21. Radio transmitting and receiving device according to claim 19, characterized in that the sleeve has a wall region which projects outwards in an elastic fashion and is bounded by two axial slots which start from the rear end side of the sleeve.

22. Radio transmitting and receiving device according to claim 21, characterized in that the wall region of the opening in the housing has an axial groove for receiving the outwardly projecting wall region of the sleeve, the axial groove being closed at the outer end side of the opening in the housing.

23. Radio transmitting and receiving device according to claim 22, characterized in that the housing has a channel which, when the sleeve is inserted, runs essentially perpendicularly to the wall region, which projects outwards in an elastic fashion, of the sleeve.

24. Radio transmitting and receiving device according to claim 22, characterized in that the side walls of the axial groove are bevelled in the circumferential direction of the opening in the housing.

25. Radio transmitting and receiving device according to claim 19, characterized in that the sleeve has a collar which comes to rest on the outside of the housing.

26. Radio transmitting and receiving device according to claim 1, characterized in that the magnet arrangement is a permanent magnet arrangement.

27. Radio transmitting and receiving device according to claim 1 characterized in that it is constructed as a hand-held telephone.

28. Radio transmitting and receiving device according to claim 1, characterized in that the first antenna is an antenna feeder extending longitudinally of the rod.

29. Radio transmitting and receiving device according to claim 1, characterized in that the rod extends to a free end, the second antenna being a helix antenna mounted at the free end of the rod.

* * * * *